United States Patent [19]

Bayer

[11] Patent Number: 4,825,186

[45] Date of Patent: Apr. 25, 1989

[54] PROCESS FOR THE ADJUSTMENT OF A THERMAL SWITCH

[75] Inventor: Helmut Bayer, Vienna, Austria

[73] Assignee: Electrovac, Fabrikation elektrotechnischer Spezialartikel Gesellschaft m.b.H., Vienna, Austria

[21] Appl. No.: 134,660

[22] Filed: Dec. 18, 1987

[30] Foreign Application Priority Data

Dec. 18, 1986 [AT] Austria ..... 3379/86

[51] Int. Cl.[4] ..... H01H 37/12; H01H 37/52

[52] U.S. Cl. ..... 337/360; 337/347; 337/354; 374/1

[58] Field of Search ..... 337/368, 374, 360, 347, 337/343, 57, 82, 94, 354; 374/1, 205

[56] References Cited

U.S. PATENT DOCUMENTS 4,365,228 12/1982 Rowley ..... 337/360
4,581,509 4/1986 Sanford et al. ..... 337/343
4,695,579 9/1987 Filippis et al. ..... 337/368

FOREIGN PATENT DOCUMENTS 284245 9/1970 Austria .

*Primary Examiner*—H. Broome
*Attorney, Agent, or Firm*—Laurence R. Brown; Alfred J. Mangels

[57] ABSTRACT

A transfer element (8) is provided in a thermal switch (1) with a housing (2), power supply lines (4) and contacts (5) and (7), with a contact spring (6) and a thermostatic bimetal plate (3). The transfer element is moved up by the snap action of the thermostatic bimetal plate and in so doing takes with it the contact spring (6), opening the contacts. In order to adapt this transfer element (8) in its length precisely to the desired nominal length, a heating into the deformation range of the material forming the transfer element (8) takes place, with a subsequent deformation of the upper edge region. This makes it possible in a simple way to produce the exact nominal length of the transfer element (8).

14 Claims, 3 Drawing Sheets

PROCESS FOR THE ADJUSTMENT OF A THERMAL SWITCH

BACKGROUND OF THE INVENTION

1. Field of the Invention

The invention relates to a process for the adjustment of a thermat switch with a temperature sensor formed from a thermostatic bimetal element with snap action, which temperature sensor is in connection with a contact system via a transfer element, and also a thermat switch.

2. Description of the Related Art

A process for the adjustment of a thermat switch is already known—according to U.S. Pat. No. 284,245, in which, given the switch, the contact distance is set by mechanical deformation of the switch housing. Such a process requires the use of a metal housing, the required contact distance not being precisely adjustable after squeezing due to the elastic behavior of the metal housing.

However, other adjustment processes are also known, in which either transfer elements are held in stock in various, closely graded lengths, the height of convexity of each individual thermostatic bimetal element and the corresponding dimension of the respective contact system are measured and the element having the correct length selected from among the transfer elements or the adjustment is carried out by bending of the carrier of the switch contact or of the contact spring.

SUMMARY OF THE INVENTION

The object of the present invention is then to create an adjustment process of the type described at the beginning in which the distance between the transfer element and contact system can be set exactly to the desired dimension, avoiding the known disadvantages.

This object is achieved according to the invention and, given a switch with the thermostatic bimetal element and the contact system, the distance between these two parts is precisely measured, whereupon, after arithmetic determination of the required nominal length of the transfer element for the distance established, the transfer element is heated at least partially and plastically deformed to the calculated nominal length. Such a process is distinguished by a simple and economical production of a transfer element corresponding precisely to the nominal length. Thus, a "made-to-measure fabrication" of the transfer element takes place for each thermal switch, with the consequence that each switch has exactly the same switching performance. Of particular advantage is the fact that, after the deformation, no labor-intensive reworking of the transfer element is required. It is of course indispensable for the precise dimensional accuracy of the transfer element to choose the plastically deformable material for the transfer element such that its deformation range is above the temperature range envisaged for the use of the switch. The nominal length (l) of the transfer element can be calculated from the following equation:

$$l=K-a+b$$

where K corresponds to the distance between the contact spring and the plane formed by the upper edge of the thermostatic bimetal plate; a corresponds to the desired distance between the contact spring and the upper end of the transfer element directly before the snapping movement of the bimetal plate; b is the depth of the dished surface of the bemetal plate directly before its snapping movement to the said plane passing through the upper edge. These two values a and b are constant dependent on the material, embossing depth and other parameters.

A further advantageous embodiment of the invention consists in that the transfer element is heated at least partially with the aid of laser beams. Such a heating for plastification has the special advantage that, on the one hand, the zone of heating can be limited precisely and, on the other hand, no disadvantageous heat storage taken place for the rapid and true-to-size curing or cooling.

A further advantageous embodiment of the invention comprises preheating the transfer element to approximately 500° C. Such a preheating of the complete transfer element results in a significant reduction in stress between the following zone heated up to the plasticizing range, intended for actuation of the contact spring, and the region of the transfer element adjoining said zone. In addition, the deformation temperature can be reached more quickly.

A further advantageous variant of the process according to the invention consists in that a number of successively arranged transfer elements are preheated in a tunnel-shaped oven and subsequently fed piece by piece to a round table rotating about an axis of rotation, whereupon the transfer element set down upon the round table is fed, with corresponding rotation of the round table in each case, to a heating or plasticizing station, to a squeezing position and, if appropriate, to a postheating station and to a cooling station, whereafter the transfer element reduced to nominal length is installed in the thermal switch. In this way, a rapid adjustment of the transfer elements to the desired nominal length can be carried out in a fitting way for assembly line production.

The invention also relates to a thermal switch with a temperature sensor formed from a thermostatic bimetal element, which temperature sensor is in connection, via a transfer element arranged between the thermostatic bimetal element and a contact system, with the contact system, and wherein the transfer element consists of an electrical insulating material, such as for example plastic or glass, which is plastically deformable under the effects of temperature. Such a thermal switch has the known advantageous properties, but the transfer element can, due to its plastic deformability, be adjusted to the required nominal length before installation in the switch.

According to a further advantageous embodiment of the switch according to the invention, the transfer element designed as an approximately rectangular plate with dished side areas has a centrally arranged continuation, the width of which corresponds at most to one-third of the width of the transfer element. This design of the transfer element with a narrower continuation makes it particularly quick and easy to deform plastically, while the remaining, wider part does not have to be heated to the deformation temperature and continues as before to perform its guidance functions for a non-blocking and low-friction vertical displacement.

A further advantageous embodiment of the invention consists in that the transfer element is formed from glass, for example Corning glass, having a plastic deformation range of approximately 650°-1150° C. This material has the advantage of a plastic deformability in a relatively high temperature range, as a result of which the transfer element can be used with the thermal switch even in equipment with relatively high ambient temperature.

Finally, a further preferred design variant of the invention consists in that the transfer element is formed from plastic, for example, from polyamide or from polycarbonate having a plastic deformaton range of approximately 180°-250° C. Such a material for a transfer element is distinguished by a relatively easy deformability in the low temperature range with a precise dimensional stability.

BRIEF DESCRIPTION OF THE DRAWINGS

The invention is described in more detail below with reference to designs illustrated by way of example in the drawings, in which.

DESCRIPTION OF THE PREFERRED EMBODIMENTS

Figure 1:
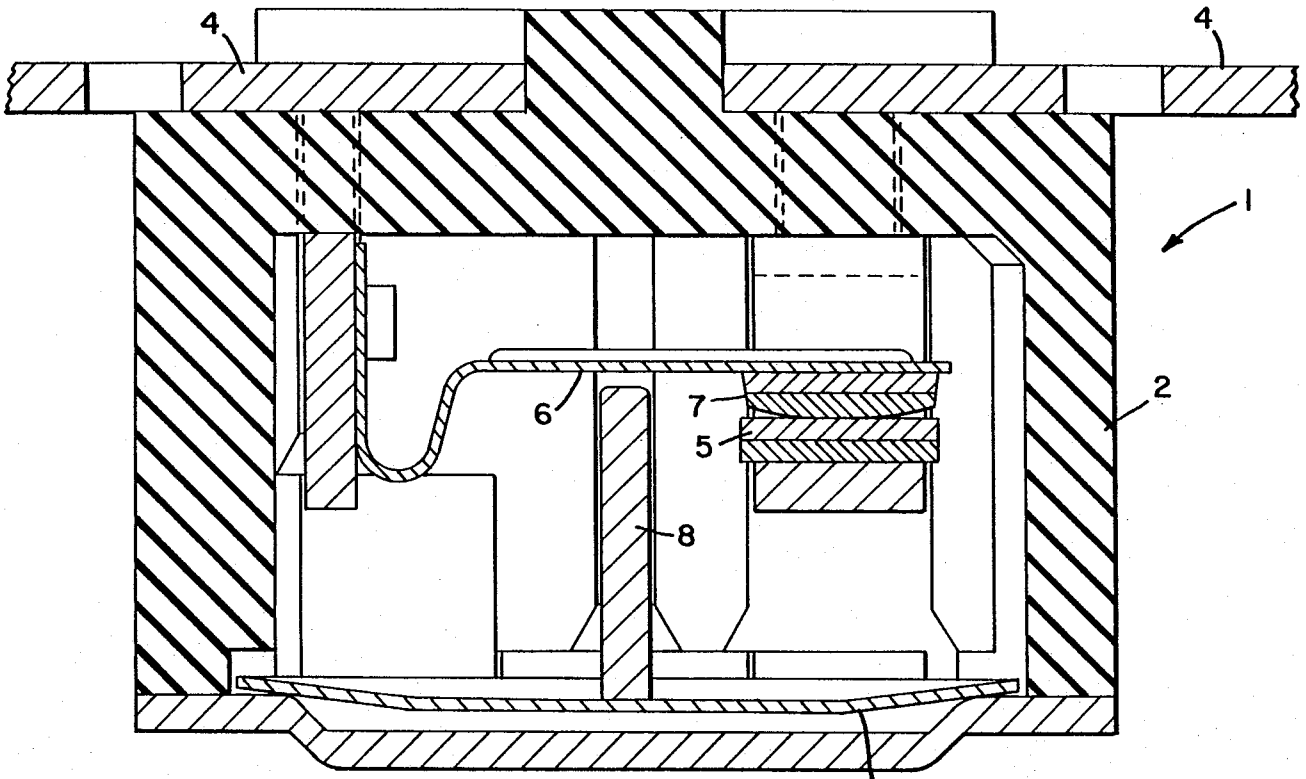
FIG. 1 shows an enlarged cross-section through a thermal switch in accordance with the present invention, FIG. 2 and FIG. 3 each show a highly diagrammatic representation of such a thermal switch with corresponding dimensions.

A thermal switch (1), which can be seen in FIG. 1, consists substantially of an, in most cases, cylindrical housing (2) of ceramic, a disc-shaped thermostatic bimetal plate (3) arranged in the bottom region, and power supply lines (4) which are connected via rivetings with a contact (5) and, respectively, with a contact spring (6) and a contact (7) fixed at the end of the latter. A plate-shaped transfer element (8) is displaceably guided approximately in the central region of the contact spring (6) and, respectively, of the thermostatic bimetal plate (3). In the production of such known thermal switches (1), the problem occurs that, owing to the poor dimensional accuracy of the ceramic housing components, relatively large tolerances occur, with the result that, when other inaccuracies with regard to the bow contacts and the like are added, the distance between the bottom of the thermostatic bimetal plate (3) and the contact spring is not always the same. However, to achieve thermal switches (1) having exactly the same switching performance, such inaccuracies must be taken precisely into account by the length of the transfer elmeent (8) being adapted to the dimensions established on the finished switch (1).

Figure 2:
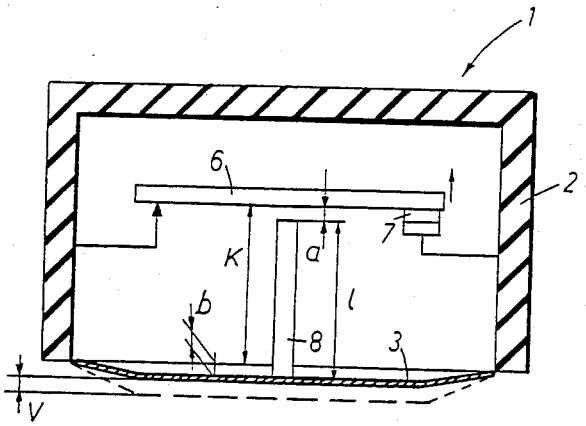

The thermal switch (1) diagrammatically represented in FIG. 2 is a normally-closed switch, i.e. it has contacts which are normally closed at room temperature and are opened with increasing temperature. The length of the transfer element (8) denoted by (l) corresponds to the desired nominal length, which can be calculated from the following equation:

$$l=K-a+b$$

In this, K corresponds to the distance, established after completion of the thermal switch (1), between the contact spring (6) and the upper edge of the thermostatic bimetal plate (3) at normal ambient temperature; a corresponds to the distance between the upper end of the transfer element (8) and the contact spring (6) directly before the snapping movement of the thermostatic bimetal plate (3). This snapping movement commences after completion of the advance creeping path V. b corresponds to the embossing depth of the thermostatic bimetal plate (3) reduced by the advanced creeping path and, like a, is a constant dependent on the material, plate thickness and further parameters. The broken-line representation of the thermostatic bimetal plate (3) corresponds to its position at normal ambient temperature. As soon as this temperature increases, a deformation takes place, represented in the diagram in FIG. 4, dependent on the temperature rise, until a snapping movement is suddenly brought about at a certain temperature - after completion of the advance creeping path V.

Figure 3:
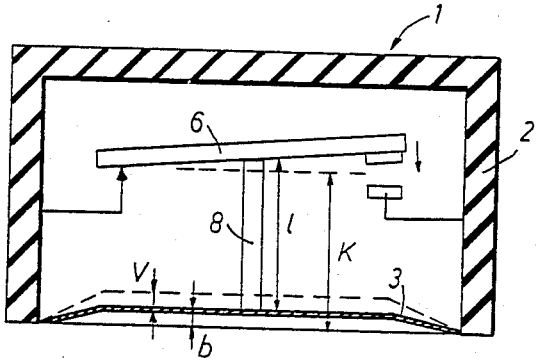

The thermal switch (1) diagrammatically represented in FIG. 3 is a so-called normally-open contact, which closes the contacts, which are open at normal room temperature, with rising temperature.

Figure 4:
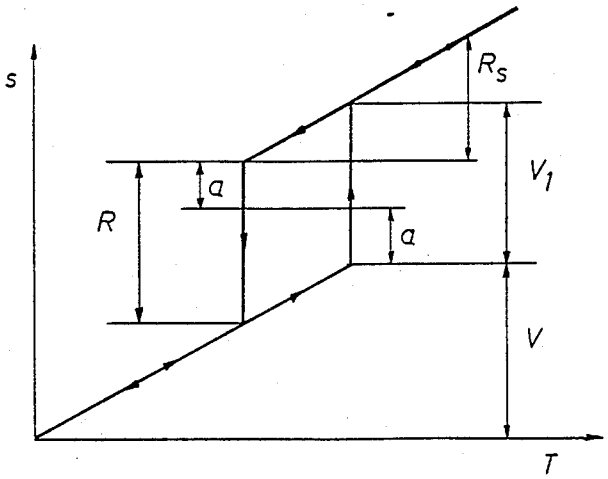
FIG. 4 shows a function diagram of the deformation path of a thermostatic bimetal disc dependent on the temperature

The diagram which can be seen in FIG. 4 shows the deformation path of the thermostatic dimetal plate (3) dependent on the temperature, a large jump (snapping movement) taking place with the advance switching path $V_1$ after completion of the advance creeping path V. On cooling of the thermostatic bimetal plate (3), the movement takes place in reverse direction, the snapping movement with the return switching path R being brought about after completion of the return creeping path Rs.

Figure 5:
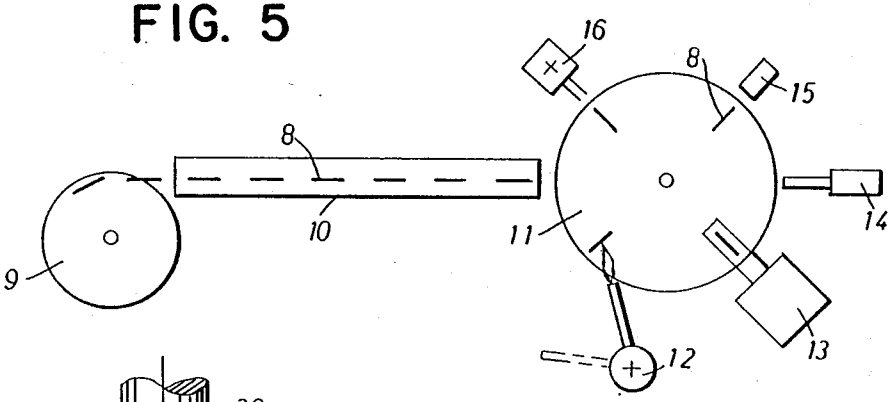
FIG. 5 shows a diagrammatic plan view of a processing operation in keeping with assembly line production, again according to the process according to the invention.

The apparatus diagrammatically represented in FIG. 5 for nominal length adjustment of the transfer elements (8) in keeping with assembly line production, is made up of a cavity resonator (9), having a plurality of transfer elements (8), a tunnel-shaped preheating oven (10) and a round table (11) which is rotatable about a vertical axis. After transfer of the transfer elements (8) into the preheating oven (10), the latter are preheated (if the transfer elements (8) consist of Corning glass, this preheating temperature is approximately 500° C.). After completion of the preheating process, a placement on the round table (11) takes place, where the transfer elements (8) are fed to individual work stations after rotation of the round table (11). The first work position is formed by a heating source (12) which can be swiveled about a vertical axis and may be formed either by a naked flame or by a laser beam. Provided next in sequence is a squeezing position (13), in which the transfer elements are reduced or deformed to the desired nominal length. In an after-burner (14), the transfer elements adjusted to the nominal length are post-heated, in order to reduce the formation of stresses in the deformation area. Next, there follows a cooling position (15), in which the heated transfer elements (8) are cooled. In a further station (16) removal of the transfer elements (8) from the round table (11) takes place, in order to feed them to the respective thermal switch (1).

Figure 6:
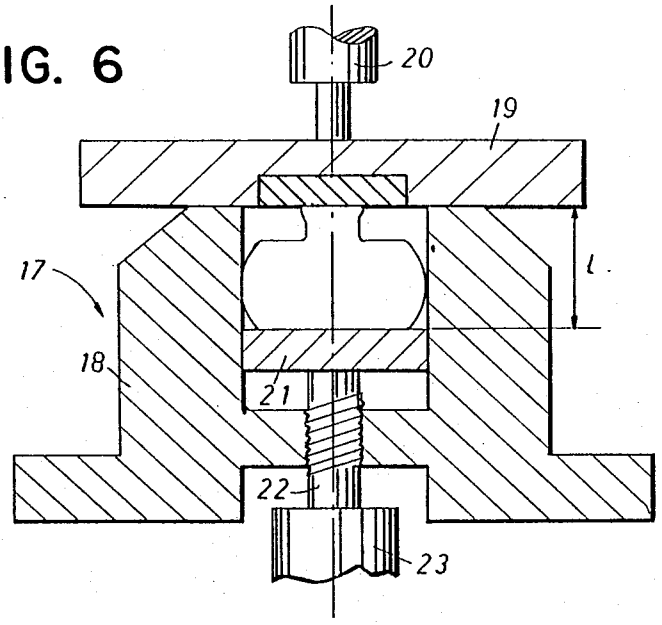
FIG. 6 shows a cross-section through a press for adjustment of the transfer element to the desired nominal length and, FIG. 7 shows an enlarged view of a transfer element.

A press (17) represented in FIG. 6, for the squeezing position (13), consists of a press frame (18) and an upper die (19), which is in connection with a hydraulic cylinder (20). A lower die (21) is in connection with a stepping motor (23) via a screw spindle (22), As soon as the required nominal length (l) has been calculated after measurement of the corresponding thermal switch (1), the corresponding adjustment of the lower die (21) takes place by means of the stepping motor, so that the upper end of the lower die (21) is located away from the upper end of the frame 18 by precisely the calculated nominal length. As soon as the transfer element (8) is introduced into the press (17), the upper die (19) can be lowered with the aid of the hydraulic cylinder (20), causing a corresponding deformation of the over-long transfer element (8). Such a press (17) has the advantage of a fast deformation capability with a large opening stroke and a limit stop control.

Figure 7:
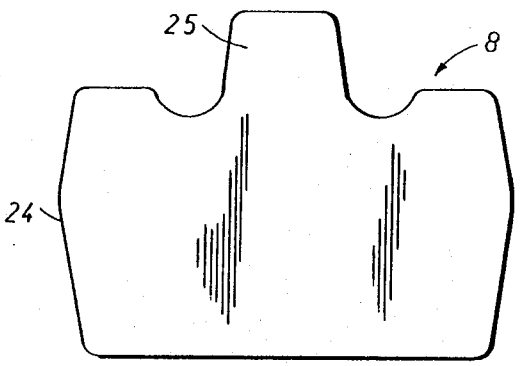

The transfer element (8) represented enlarged in FIG. 7 has dished side areas (24) and a central continuation (25). Preferably, the width of central continuation (25) is equivalent at most to one-third of the width of the transfer element. Such a design has the advantage that only this continuation, having a relatively low mass, has to be heated to deformation temperature and deformed. The remaining, larger part of the transfer element (8) remains completely unaffected by this operation.

The invention is not restricted to the embodiment of a rectangular plate represented and described. The thermally deformable transfer element may also be made in the form of a cylindrical pin guided in the housing, which pin is upset at its free ends under the effect of heat for the purpose of the adjustment according to the invention.

I claim:

1. A process for the adjustment of a thermal switch including a housing, a temperature sensor defined by a snap acting thermostatic bimetal element, which sensor is in connection with a contact via a transfer element, said process comprising: a) providing a switch with a dished, snap acting thermostatic bimetal element and a contact, b) measuring the distance between the bimetal element and the contact, c) arithmetically determining the necessary nominal length of the transfer element, d) at least partially heating the transfer element to its plastic deformation temperature, and e) plastically deforming the transfer element to the arithmetically determined nominal length.

2. A process as claimed in claim 1, wherein the heating step is performed at least partially with a laser beam.

3. A process as claimed in claim 1, including the step of preheating the transfer element before the heating step.

4. A process as claimed in claim 1, including preheating a number of successively arranged transfer elements in a tunnel-shaped oven, feeding the preheated transfer elements piece by piece to a table rotatable about an axis of rotation, setting a transfer element down on the table, successively rotating the table to a heating station, to a squeezing station, and to a cooling station, and installing the transfer element reduced to a nominal length in the thermal switch.

5. A thermal switch comprising: a contact, a temperature sensor, and a transfer element positioned between the contact and the temperature sensor, wherein the temperature sensor is a thermostatic bimetal element, and wherein the transfer element is made from an insulating material and includes a body portion and a substantially centrally positioned continuation portion that extends outwardly from the body portion, wherein the continuation portion is adapted to be plastically deformed to a desired length by heating while the size of the body portion remains unchanged.

6. A switch as claimed in claim 5 wherein the transfer element is formed from glass having a plastic deformation range of about 650°–1150° C.

7. A switch as claimed in claim 5 wherein the transfer element is formed from plastic a plastic deformation range of approximately 180°–250° C.

8. A process as claimed in claim 4, including the step of feeding a transfer element to a post-heating station after the squeezing step.

9. A switch as claimed in claim 5, wherein the transfer element is a plastic.

10. A switch as claimed in claim 5, wherein the transfer element is glass.

11. A switch as claimed in claim 8, wherein the plastic is a polyamide.

12. A switch as claimed in claim 8, wherein the plastic is a polycarbonate.

13. A process as claimed in claim 1, wherein the nominal length is defined by the following relationship:

$$l = K - a + b$$

wherein, l is the nominal length of the transfer element.

K is the distance between the upper edge of the bimetal element and the contact, a is the desired distance between the contact and the upper end of the transfer element, and b is the depth of the dished surface of the bimetal element.

14. A thermal switch comprising: a contact, a temperature sensor, and a transfer element positioned between the contact and the temperature sensor, wherein the temperature sensor is a thermostatic bimetal element, and wherein the transfer element is made from an insulating material which can be plastically deformed by heating and is a substantially rectangular plate having a pair of opposed dished sides spaced from each other to define the width of the transfer element, and a substantially centrally arranged continuation extending from a side connecting the dished sides, the width of which continuation is less than about one-third of the width of the transfer element.

* * * * *